US006891471B2

(12) United States Patent
Yuen et al.

(10) Patent No.: US 6,891,471 B2
(45) Date of Patent: May 10, 2005

(54) EXPANDABLE OBJECT TRACKING SYSTEM AND DEVICES

(75) Inventors: Pui Hang Yuen, Room 21, 16/F., Goldfield Ind. Ctr., Fotan, Shatin, N.T., Hong Kong (CN); Sik Hing Yuen, Shatin (HK); Laurence J. Minikes, San Rafael, CA (US)

(73) Assignee: Pui Hang Yuen, Shatin (HK)

( * ) Notice: Subject to any disclaimer, the term of this patent is extended or adjusted under 35 U.S.C. 154(b) by 495 days.

(21) Appl. No.: 10/164,092

(22) Filed: Jun. 6, 2002

(65) Prior Publication Data

US 2004/0203859 A1 Oct. 14, 2004

(51) Int. Cl.[7] ..... G08B 1/08

(52) U.S. Cl. ..... 340/539.32; 340/539.1; 340/539.11; 340/539.32; 340/539.13; 340/573.1

(58) Field of Search ..... 340/539.1, 539.11, 340/539.32, 539.12, 539.13, 573.1, 573.4, 539.15

(56) References Cited

U.S. PATENT DOCUMENTS

| | | | | | |
|---|---|---|---|---|---|
| 3,970,987 | A | | 7/1976 | Kolm | 340/15 |
| 4,101,873 | A | | 7/1978 | Anderson et al. | 340/539 |
| 4,413,198 | A | | 11/1983 | Bost | 310/324 |
| 4,476,469 | A | | 10/1984 | Lander | 340/825.49 |
| 4,507,653 | A | | 3/1985 | Bayer | 340/539 |
| 4,922,229 | A | | 5/1990 | Guenst | 340/572 |
| 5,204,657 | A | | 4/1993 | Prosser et al. | 340/568 |
| 5,294,915 | A | | 3/1994 | Owen | 340/539 |
| 5,450,070 | A | | 9/1995 | Massar et al. | 340/825.35 |
| 5,537,459 | A | * | 7/1996 | Price et al. | 455/435.1 |
| 5,638,050 | A | | 6/1997 | Sacca et al. | 340/571 |
| 5,673,023 | A | | 9/1997 | Smith | 340/571 |
| 5,677,673 | A | | 10/1997 | Kipnis | 340/539 |
| 5,677,675 | A | | 10/1997 | Taylor et al. | 340/568 |
| 5,680,105 | A | | 10/1997 | Hedrick | 340/571 |
| 5,686,891 | A | | 11/1997 | Sacca et al. | 340/571 |
| 5,708,423 | A | * | 1/1998 | Ghaffari et al. | 340/5.8 |
| 5,859,585 | A | | 1/1999 | Fleming | 340/539 |
| 5,926,090 | A | | 7/1999 | Taylor et al. | 340/568.1 |
| 5,939,981 | A | | 8/1999 | Renney | 340/539 |
| 5,945,918 | A | | 8/1999 | McGonigal et al. | 340/825.36 |
| 5,949,328 | A | | 9/1999 | Latty | 340/326 |
| 5,999,799 | A | | 12/1999 | Hu et al. | 455/67.7 |
| 6,012,029 | A | | 1/2000 | Cirino et al. | 704/275 |
| 6,366,202 | B1 | | 4/2002 | Rosenthal | 340/539 |
| 6,539,393 | B1 | * | 3/2003 | Kabala | 707/102 |
| 6,549,625 | B1 | * | 4/2003 | Rautila et al. | 380/258 |
| 6,609,656 | B1 | * | 8/2003 | Elledge | 235/382 |

* cited by examiner

*Primary Examiner*—Daryl C Pope
(74) *Attorney, Agent, or Firm*—Alix, Yale & Ristas, LLP

(57) ABSTRACT

An object tracking system is constructed by linking a plurality of devices. Each device includes an RF transceiver, memory, a user interface and a processor for coordination and management of these components. The devices are programmed to form a link with another compatible device by wirelessly exchanging their unique ID codes for storage in the other's memory. The devices are responsive to messages from each device whose ID is stored in memory. Responses may range from sounding an alarm to actuation of a switch to detection of the presence or absence of another linked device. The simple, linkable devices, permit construction of complex and flexible networks for the purposes of object tracking, proximity detection, remote actuation and more. Each of the operations including linking, unlinking and general action is initiated by a single key of the device.

12 Claims, 7 Drawing Sheets

EXPANDABLE OBJECT TRACKING SYSTEM AND DEVICES

BACKGROUND OF THE INVENTION

1. Field of the Invention

This invention relates generally to tracking objects and more particularly to an expandable object tracking system utilizing a plurality of linkable devices.

2. Description of the Related Art

People frequently need assistance with keeping track of important objects such as pagers, cell phones, laptops, keys, remote controls for security and entertainment devices, etc. It is known in the art to, for example, equip the base station for a cordless phone and associated cordless phone with a feature that allows a button on the base station to activate an alarm in the phone to aid in locating the phone. Similar systems are available for entertainment system remote controls. These and other systems are based on the master/slave model in which a sophisticated master device such as a personal digital assistant (PDA) or laptop computer is capable of tracking a number of passively tagged objects. A drawback of these master/slave systems is that damage to or misplacement of the master device keeps the system from functioning.

There is a need in the art for an inexpensive, flexible, expandable, and easy to use object tracking system not based on the master/slave model.

SUMMARY OF THE INVENTION

An object tracking system in accordance with the present invention includes a plurality of functionally identical general devices that wirelessly communicate with each other. Each of these general devices includes an RF transceiver circuit permitting transmission and reception of radio frequency signals; a microcontroller; visual indicators such as LED's; audio indicators such as buzzers or tone-signal generators; memory; and a user interface such as a keyboard. The general devices are programmed to establish a linkage with compatible devices. The link is established by an exchange of unique identifiers between the devices, with each device storing the unique identifier of the other device in memory. To simplify the operation, the linkage operation is initiated by a single action such as a single push of a button.

The devices communicate by radio frequency (RF) with each communication in the form of a packet having a preamble, a message type, a device ID and optionally a data field and checksum field. A receiving device confirms that the identification of the transmitting device is stored in memory, e.g., that the devices are linked. If the message is from a linked device, the receiving device responds according to the message type and data content of the message. The link request is an example of one message type. There may be a number of different message types as will be further discussed below.

The system may also include non-general or specialized extension devices. An example of a extension device may be a device used to track the proximity of an object or person relative to a particular general device. The extension device adds its functionality, e.g., proximity detection, to the object tracking system. Many other extension device functions are possible. The object tracking system is therefore not only expandable by the number of devices in the system but also in its capabilities by adding extension devices.

An object tracking system in accordance with the present invention is flexible in that additional general devices and extension devices may be added or subtracted as necessary. Each of the general devices in an object tracking system in accordance with the present invention has all of the capabilities of the other general devices. Therefore, object tracking systems can be configured in which the loss of any one general device does not interrupt operation of the system.

An object of the present invention is to provide a new and improved object tracking system and related devices that do not rely on master object tracking units.

Another object of the present invention is to provide a new and improved object tracking system and related devices having improved ease of use.

A further object of the present invention is to provide a new and improved object tracking system that is configurable to perform other functions.

A yet further object of the present invention is to provide a new and improved object tracking system configured as a flexible and expandable network of linked devices.

BRIEF DESCRIPTION OF THE DRAWINGS

These and other objects, features and advantages of the invention will become readily apparent to those skilled in the art upon reading the description of the preferred embodiments in conjunction with the accompanying drawings, in which.

DETAILED DESCRIPTION OF THE PREFERRED EMBODIMENT

An object tracking system in accordance with the present invention is illustrated in FIGS. 1–7. The invention contemplates a user-configurable object tracking system 100 including a plurality of is general devices (GenD) 10 with substantially similar (if not identical) capabilities and configurations. Extension devices (ExD) 12, 14 dedicated to a particular purpose and linked to the object tracking system 100 are also contemplated.

Figure 1:
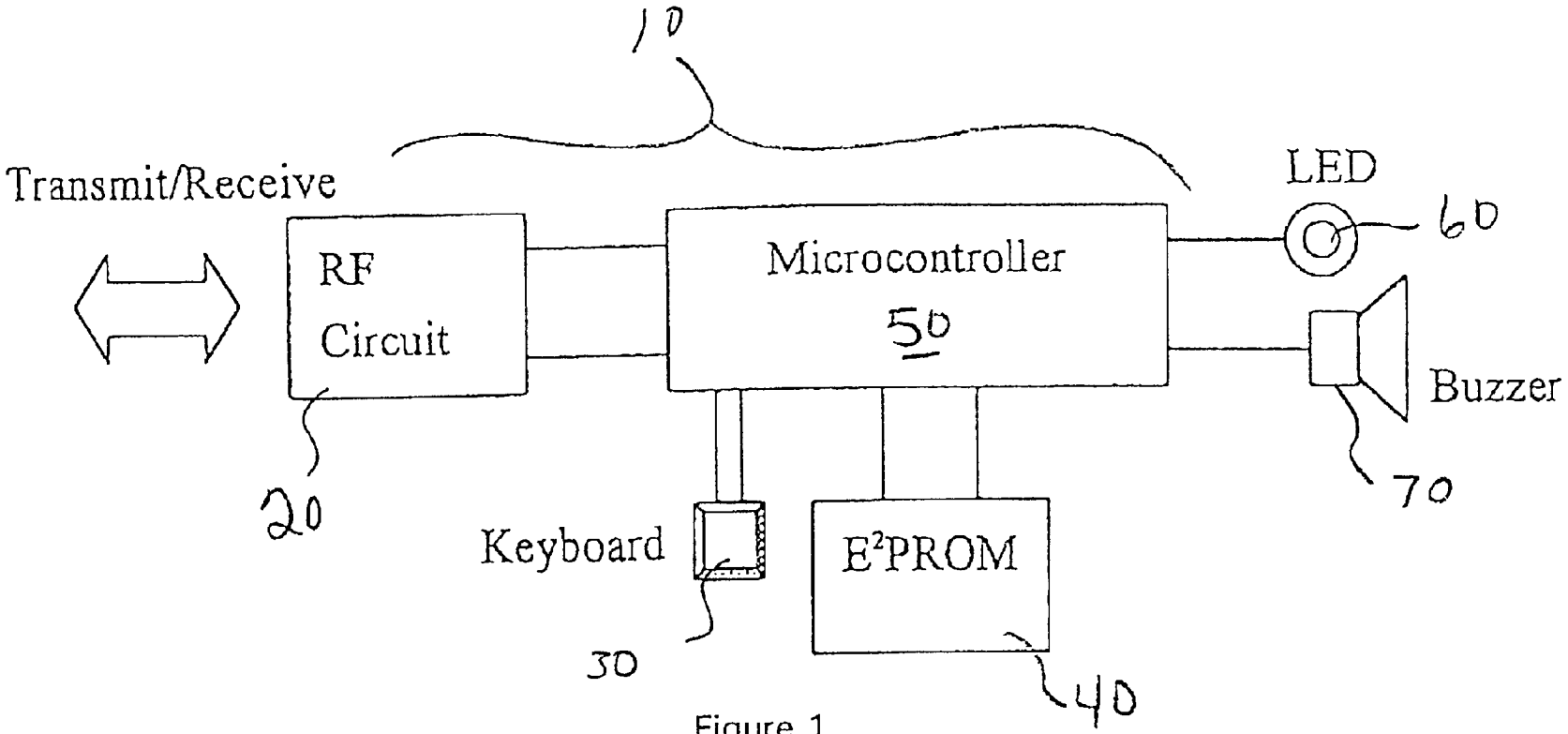
FIG. 1 is a block diagram illustrating the primary components of a general object tracking device in accordance with the present invention.

FIG. 1 illustrates the primary components of a representative GenD 10 in accordance with the present invention. Each GenD 10 will include a radio frequency (RF) transceiver 20 to facilitate exchange of information with other devices in the object tracking system. The GenD 10 will include user interface components such as LED's 60 for visual indication, buzzers or alarms 70 for audio indication and a keyboard 30 to receive user inputs. Other forms of user interface such as voice activation or a vibratory alarm may also occur to one skilled in the art. A microcontroller 50 with linked programmable memory ($E^2$PROM) 40 coordinates the activity of the GenD 10. It is contemplated that these components be arranged in a very compact package similar in configuration to a car alarm remote. The compact package is suitable for attachment to, for example, car keys, cellphones, wallets and the like. The compact package may take alternative forms such as a smart card or sticky tag suitable for unobtrusive inclusion in a wallet or application to, for example, a laptop computer.

The RF signals exchanged between GenDs 10 in packets comprise a preamble, message type, device ID and may include data and checksum fields.

TABLE 1

| DATA PACKET FORMAT |
|---|
| PREAMBLE |
| MESSAGE TYPE |
| DEVICE ID |
| DATA |
| CRC CHECKSUM |

The PREAMBLE alerts devices receiving the signal that a message from a compatible device follows. The MESSAGE TYPE field alerts the receiving devices as to the type of action requested. The DEVICE ID field contains a unique identifier associated with the sending device. The DATA field is used to transfer information associated with the particular message type indicated in the message type field. Each message packet concludes with a CRC CHECKSUM field permitting the receiving device to check for errors in transmission or reception. The DEVICE ID does not change from message to message. The CRC CHECKSUM field content varies according to the total message packet content and is used only for error checking. The DATA field varies for each message type.

In the illustrated embodiment, the six primary message types are illustrated in Table 2 as follows:

TABLE 2

MESSAGE TYPES

| MESSAGE TYPE | DATA CONTENT | MEANING |
|---|---|---|
| GEN. MESSAGE | — | TAKE GENERAL ACTION |
| LINK REQUEST | LINK TYPE (GENERAL OR PROX.) | REQUEST FOR ESTABLISHING LINK OF SPECIFIED TYPE |
| UNLINK REQUEST | — | REQUEST TO UNLINK |
| FEEDBACK | ID OF LINK REQUEST SENDER, LINK TYPE | RESPONSE TO LINK OR UNLINK MESSAGE |
| CONFIRMATION | ID OF FEEDBACK SENDER | RESPONSE TO FEEDBACK |
| PROXIMITY | PROXIMITY FUNCTION ON/OFF | |

The LINK REQUEST and UNLINK REQUEST message types will be discussed with reference to the computer program flow chart illustrated in FIG. 5. The FEEDBACK and CONFIRMATION message types are intimately related with the program steps for linking and unlinking of devices and are illustrated and discussed with reference to program steps of FIG. 5. The GEN. MESSAGE and PROXIMITY message types will be discussed with reference to the program flow chart illustrated in FIG. 6.

Figure 7:
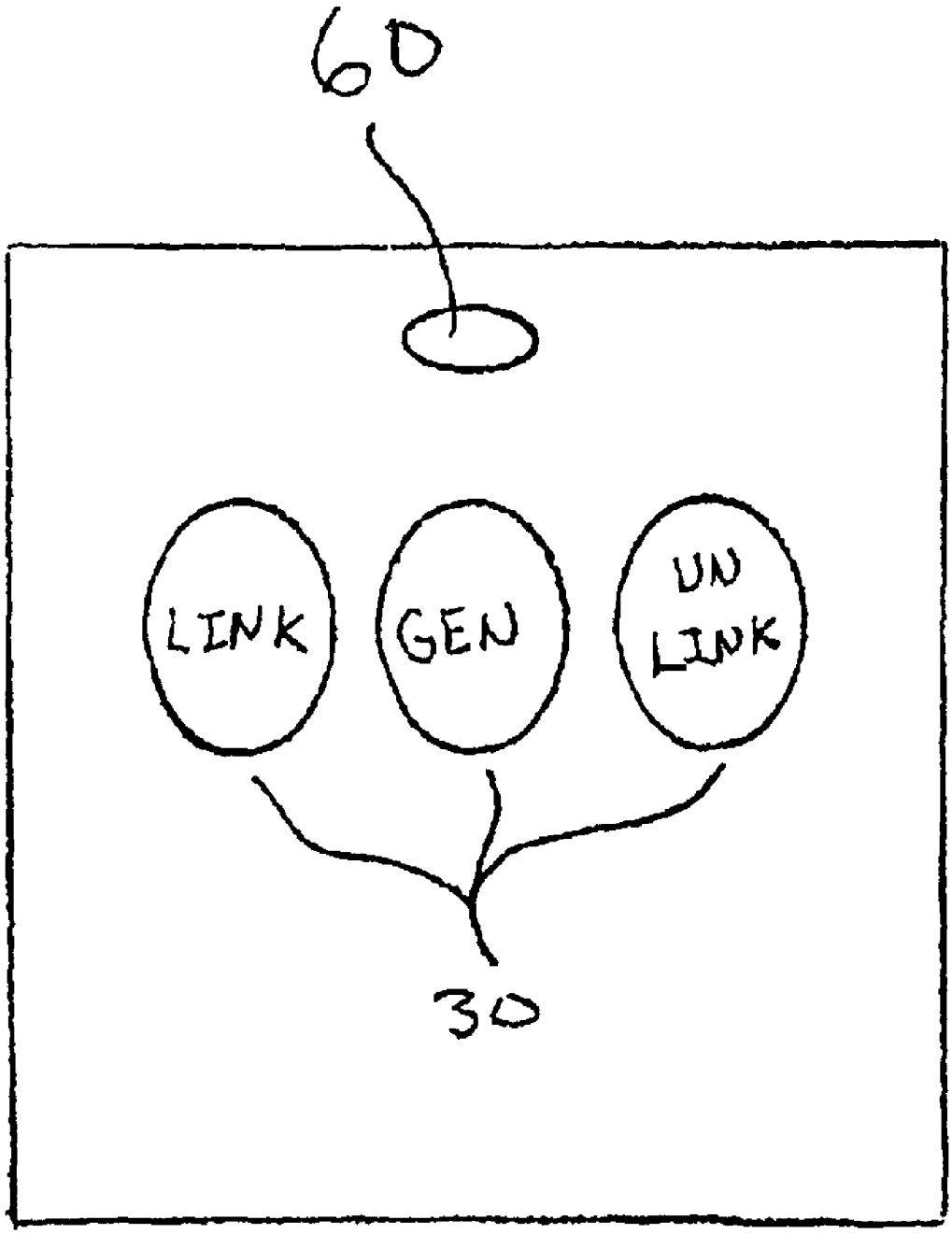
FIG. 7 illustrates one possible embodiment of a keypad appropriate for use in conjunction with a general device in accordance with the present invention.

In accordance with one aspect of the present invention, GenDs 10 will only respond to message packets from linked devices. Each device, whether a GenD 10 or ExD 12, 14 has a unique DEVICE ID that accompanies each message packet in the DEVICE ID field. With reference to FIG. 5, devices are linked to each other when the device IDs are exchanged and stored in memory. FIG. 5 illustrates program steps that exchange the device ID's between the devices for storage in their respective memory. FIG. 7 illustrates a representative keypad including a link button.

Figure 5:
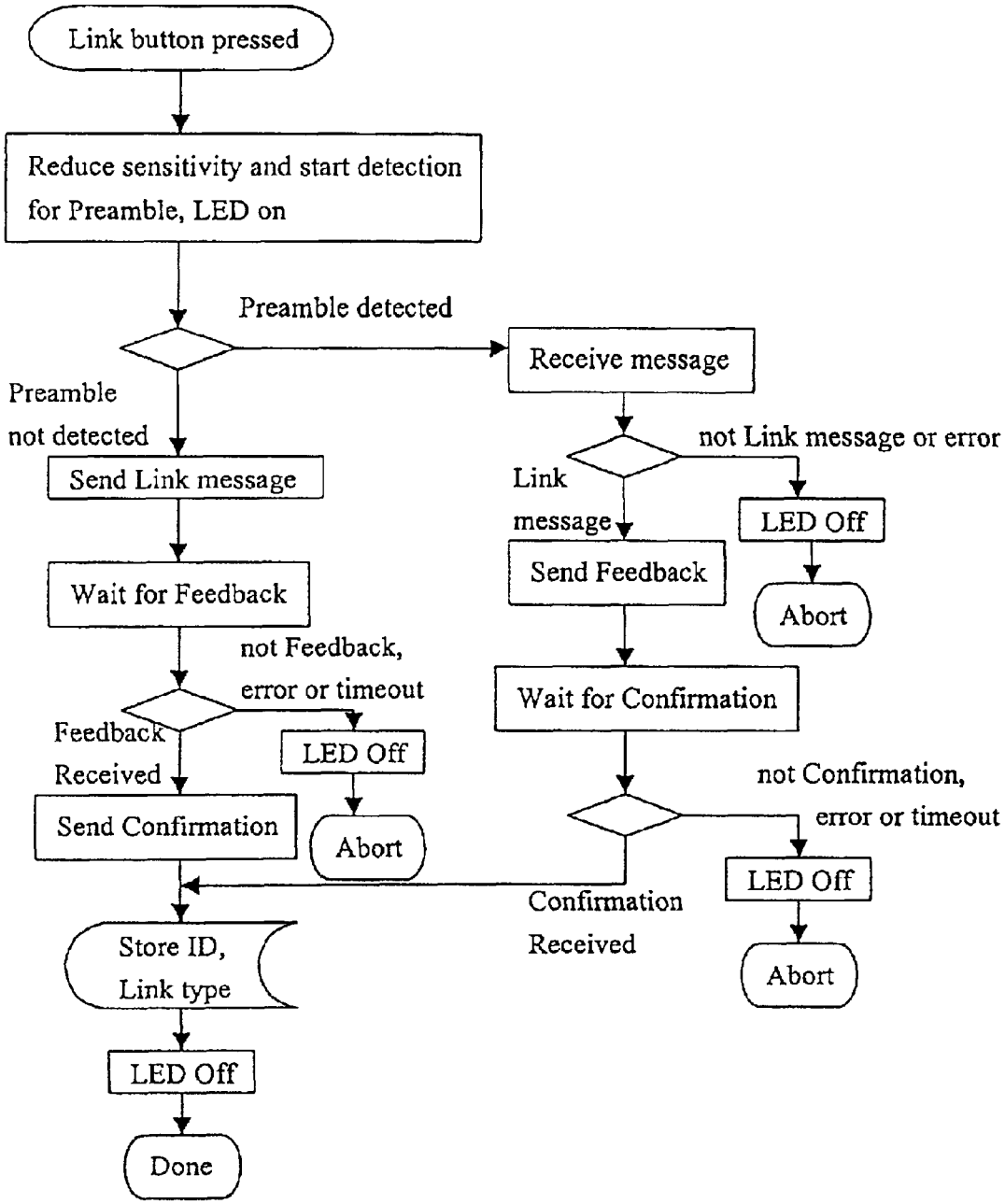
FIG. 5 is a program flowchart illustrating representative program steps for the establishment of a link between devices in an object tracking system in accordance with the present invention.

The linking steps illustrated in FIG. 5 are initiated by placing the devices to be linked in proximity to each other and pressing the link button on both devices. In accordance with the program steps illustrated in FIG. 5, each device will first look for a received PREAMBLE. If a PREAMBLE is not detected, the device will proceed to transmit its own LINK REQUEST message. Upon detection of a PREAMBLE, the receiving device evaluates the incoming message packet for MESSAGE TYPE. If the message is a LINK REQUEST, the receiving device will transmit a FEEDBACK packet including the DEVICE ID associated with the requesting device as part of a handshaking. The requesting device, upon reception of the FEEDBACK packet containing its own DEVICE ID will in turn transmit a CONFIRMATION packet containing the ID of the FEEDBACK packet sender to complete the handshake. After the handshake is completed, each device participating in the linking steps stores the DEVICE ID corresponding to the other device. The devices are now "linked" by virtue of their DEVICE ID being stored in the memory of the other linked device or devices.

Figure 5A:
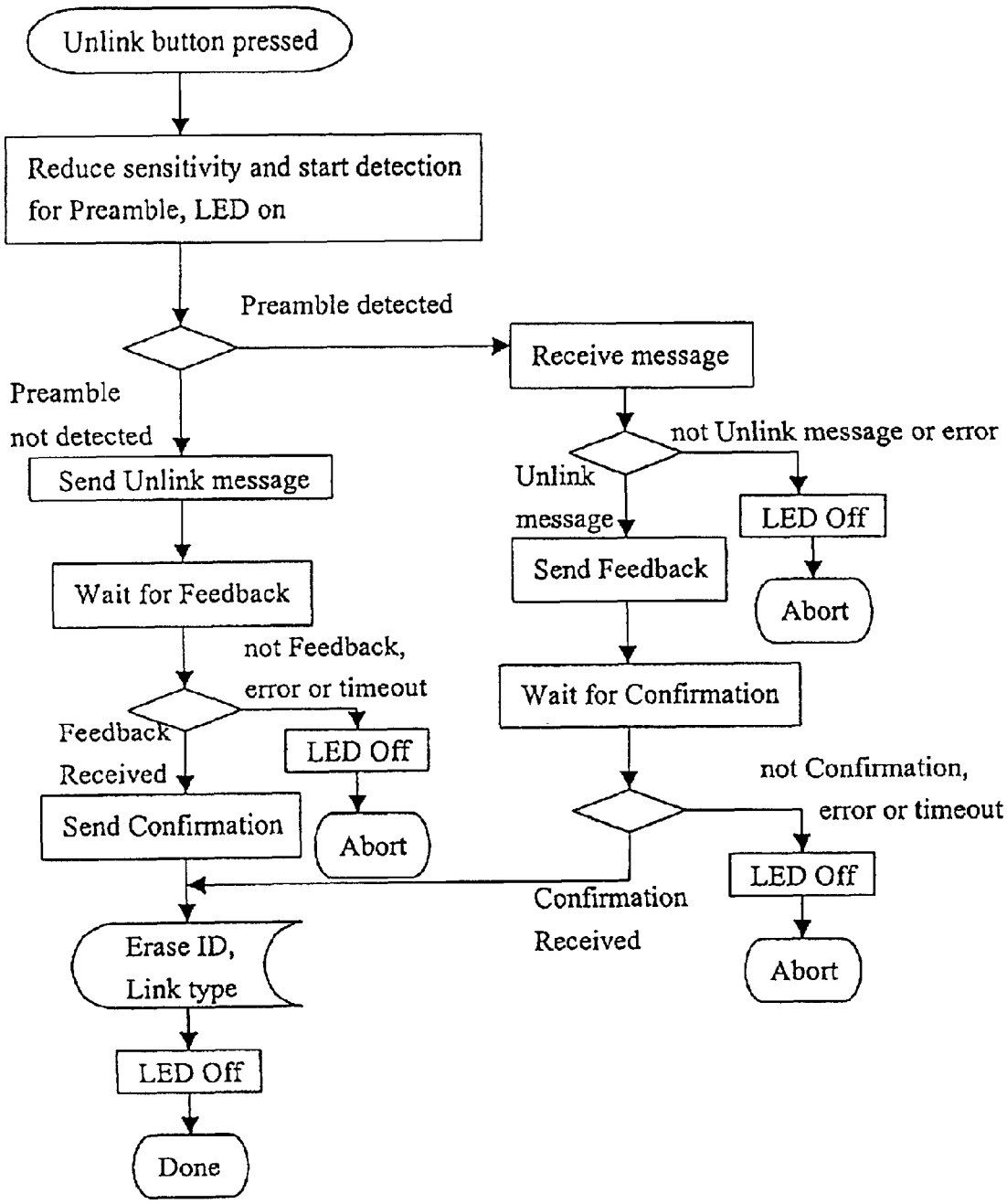
FIG. 5A is a program flowchart illustrating representative program steps for the termination of a link between devices in an object tracking system in accordance with the present invention.

Removing a device from the object tracking system is just as easy and adding a device. The steps for responding to an UNLINK REQUEST are similar to the steps for executing a LINK REQUEST, as illustrated in FIG. 5A. The unlinking steps are initiated by pressing the "unlink" button on both devices. An UNLINK REQUEST is sent and received instead of the LINK REQUEST. In response to an UNLINK REQUEST, the devices remove the DEVICE ID and link type associated with the devices to be unlinked from memory. Linked devices are responsive to messages from other linked devices, but not to messages from unlinked devices.

In the illustrated embodiment, at least two types of links may be established with a GenD 10. A general link will cause linked devices to respond to a GENERAL MESSAGE as described below. A PROXIMITY LINK will cause a GenD 10 to respond to a PROXIMITY message by enabling or disabling the proximity function described below with reference to FIG. 6.

Figure 2:
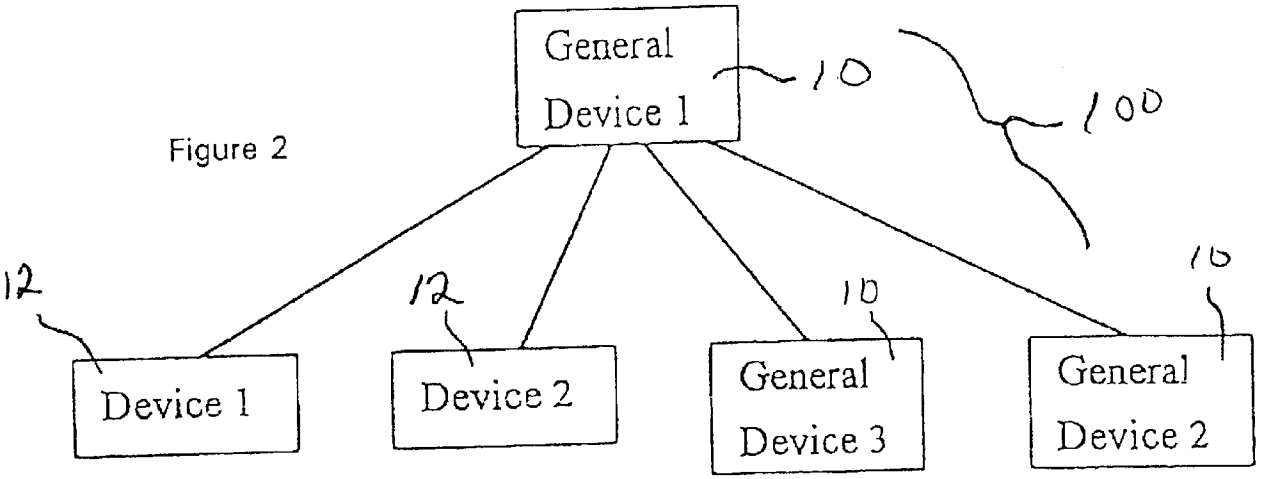
FIG. 2 is an organizational block diagram illustrating an object tracking system including several linked devices in accordance with the present invention.

FIG. 2 illustrates a simple object tracking system 100 comprising one GenD 10 that has been linked to two other GenDs 10 and two ExDs 12. It will be noted that a link has not been established between any of the other components of the object tracking system (although interconnecting all the components is possible in accordance with the present invention). In this system 100, a message packet transmitted by GenD 1 will be received and responded to by each of the other devices in the system by virtue of their linkage with GenD 1. However, a message packet transmitted by GenD 2 will be received and responded to only by GenD 1. In such a system, loss or misplacement of GenD 1 is a problem because the other devices in the system are not linked to each other. This was typical of many prior art master/slave type object tracking systems.

Figure 3:
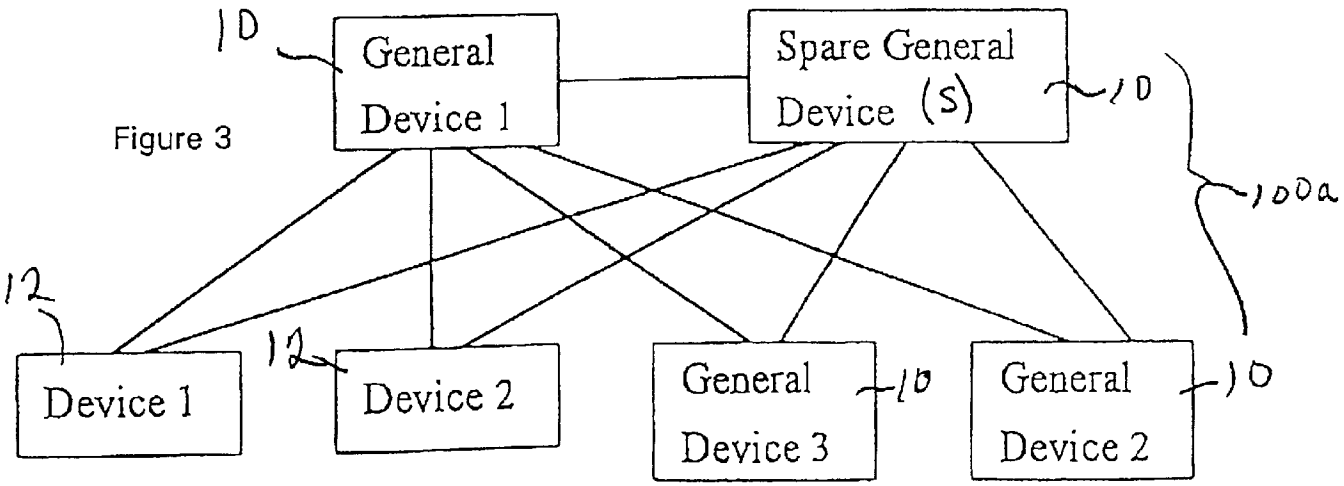
FIG. 3 is an organizational block diagram illustrating an alternative object tracking system comprising a network of linked general devices and extension devices.

FIG. 3 illustrates a more sophisticated object tracking system 10*a* in accordance with the present invention. Each of a GenD 1 and spare GenD (S) are linked to each other and to all of the other devices in the system. Thus, GenD 1 and the spare GenD (S) are equivalent to each other for system purposes. If GenD 1 is lost or misplaced, the spare GenD (S) may be used to locate any of the other devices in the system 100*a* of FIG. 3. It should be noted that device 1, device 2, GenD 3 and GenD 2 are linked to GenD 1 and the spare GenD but not to each other. In this object tracking system, a message from GenD 1 will be received and responded to by all of the other devices in the system, whereas, for example, a message from GenD 3 will be responded to by only GenD 1 and the spare GenD (S). This form of system would be appropriate for keeping track of, say, keys and a phone with GenD 3 and GenD 2, respectively. Device 1 and device 2 may be ExDs dedicated to a particular function, such as a proximity alarm or remote switch.

Figure 6:
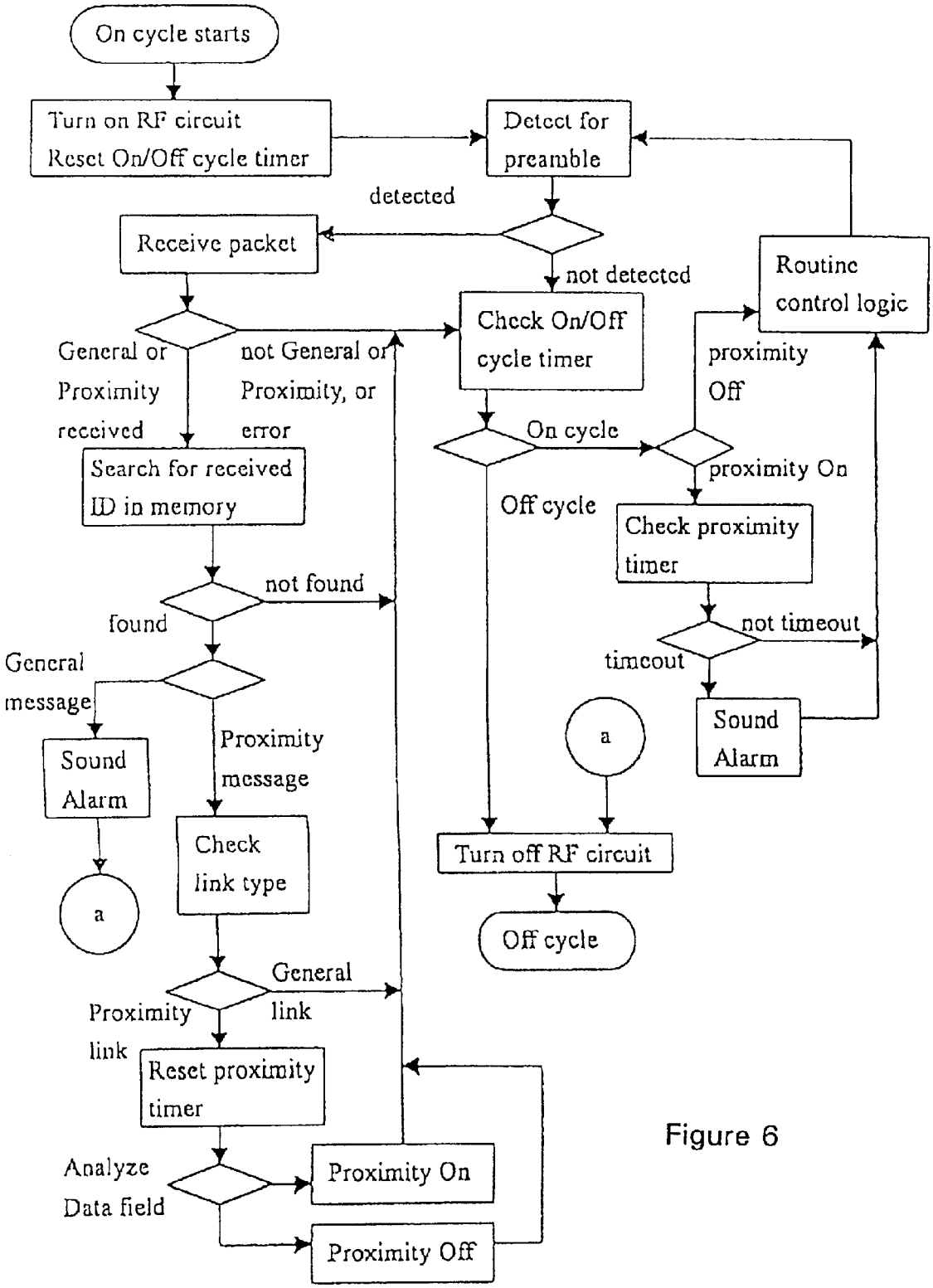
FIG. 6 is a program flowchart illustrating the representative steps in a primary program loop for a general device in accordance with the present invention.

FIG. 6 illustrates a representative programmed on/off cycle for a GenD in accordance with the present invention. To preserve battery power, GenDs are programmed to periodically shut down or "off" cycle. At the beginning of each "on" cycle the RF transceiver is activated to detect signals from local devices. If a PREAMBLE is detected, the GenD receives the packet, determines the MESSAGE TYPE, confirms that the sending device is a linked device by looking up the DEVICE ID in memory and responds to a message from a linked device according to the MESSAGE TYPE and DATA content.

A GENERAL MESSAGE in the illustrated embodiment, which in a GenD is initiated by a single push of the GEN (general action) button, activates the alarm function on all linked devices. For example, in the object tracking system 100 of FIG. 2, a GENERAL MESSAGE from GenD 1 would activate the alarm function on device 1, device 2, GenD 2 and GenD 3. Device 1 and device 2 are extension devices and may be programmed to respond to a general message from a linked device by taking some particular action, such as actuating an electronic switch.

In contrast, in the object tracking system of FIG. 3, a GENERAL MESSAGE transmitted from GenD 3 would activate the alarm function of GenD 1 and the spare GenD (S) but not the other devices in the system as they are not linked to GenD 3. The GENERAL MESSAGE will typically be used to locate lost or misplaced items by following the audio alarm emitted from linked devices. The activation of an alarm is a representative functionality for the GENERAL MESSAGE. The invention contemplates that the GENERAL MESSAGE may be used for other functions as may occur to those of skill in the art.

A further type of message is the PROXIMITY message. If a PROXIMITY LINK has been established between a GenD 12 and an ExD, the GenD (when the proximity function is enabled) will maintain a timer for the presence of the proximity linked ExD 14, as illustrated in FIG. 6. The program establishes a proximity timer for each proximity-linked device 14. If the presence of the proximity-linked ExD 14 is not detected before the timer expires, the GenD will sound an alarm. If the proximity-linked ExD 14 is detected as present, then the proximity timer is reset and the process continues.

The proximity device signals its presence by transmitting a proximity message. Different proximity devices may be provided with transmitters having different power to permit a greater or lesser range to the person or thing associated with the proximity device. For example, a very young child might be given a proximity device with a short range while an older child might be given a proximity device having a relatively long range. By virtue of their function, the proximity device must transmit in a pattern or constantly to ensure its detection by a general device 10.

Figure 4:
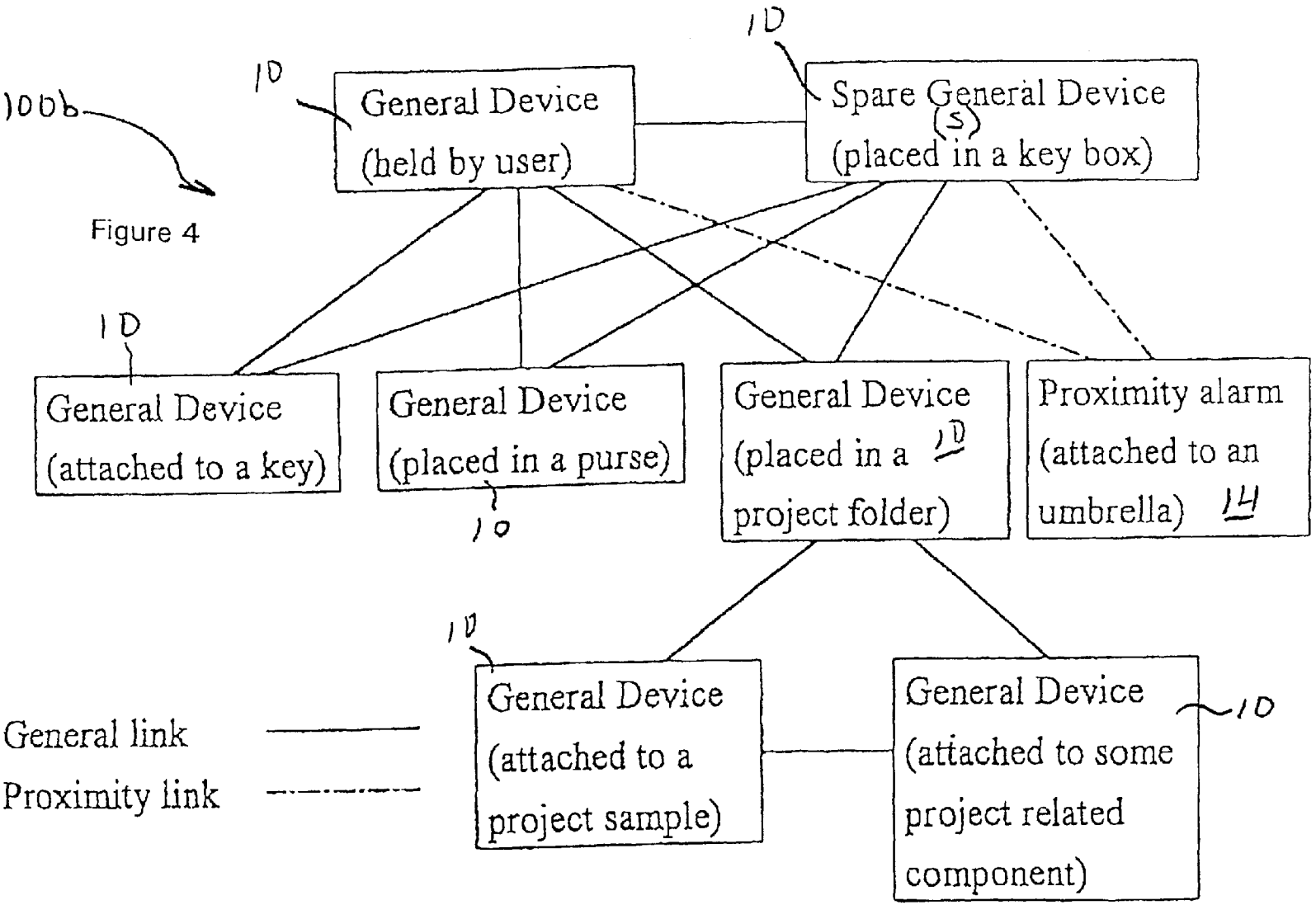
FIG. 4 is an organizational block diagram illustrating an extended object tracking system in accordance with the present invention.

FIG. 4 is an example of the flexibility of an object tracking system 100*b* in accordance with the present invention. The upper portion of the Figure illustrates a GenD 10 (held by user) and a linked spare GenD (S) (placed in a keybox). The GenD and spare GenD (S) are each linked to three GenDs by a general link. One of these GenDs is attached to a key, another is placed in a purse and a third is placed in a project folder. Each of the GenD and spare GenD have a proximity link established with a proximity ExD 14 attached to an umbrella. The GenD placed in a project folder is further linked to a GenD (attached to a project sample) and a GenD (attached to some project related component). Each of the project related GenDs are linked to each other while the GenD (placed in a project folder is linked to both the other project related GenDs, the GenD (held by user) and the spare GenD (S). Such a system 100*b* might be used to keep track of keys, a purse and detect whether you are leaving the office without your umbrella. A GENERAL MESSAGE from the primary GenD will cause the alarm to sound on each of the GenDs associated with a key, a purse and in the project folder. A GENERAL MESSAGE sent from the GenD in the project folder will cause the alarm to sound on each of the other project-related GenDs as well as the primary GenD and spare GenD (S).

It can be seen from the representative object tracking systems 100, 100*a*, 100*b* illustrated in FIGS. 2, 3 and 4 that the object tracking system and devices in accordance with the present invention can be used to create object tracking systems tailored to the needs of the user. These systems can be built up and reformed using components interchangeable by linking and unlinking with a single push of a button. Overlapping or separate systems may be constructed using interchangeable parts.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An object tracking device (OTD) for establishing a wireless link with compatible devices having RF receiver/transmitter means for transmitting and receiving unique self-identification codes (IDs), said OTD comprising:

RF circuit means for transmitting and receiving RF signals;

user interface means for interfacing with a user, said interfacing comprising audio and visual signaling to the user and permitting user inputs to the OTD;

alarm means for producing an alarm signal;

memory means for storage of identification codes (ID) including at least one unique ID for self-identification; and processor means for processing received RF signals and user inputs, management of said memory and control of said alarm means, wherein said OTD establishes a wireless link with a plurality of said compatible devices by receiving the ID of each of said plurality of compatible devices and storing said ID in said memory means and transmitting its self-identification ID to each of said compatible devices for storage therein and said OTD terminates said wireless link with a particular device by erasing an ID associated with the particular device from memory and transmitting its self-identification ID to the particular device for removal therefrom, whereby said OTD is responsive to RF signals from compatible devices whose IDs are stored in said memory.

2. The OTD of claim 1, wherein said wireless link comprises either a general link or a proximity link.

3. The OTD of claim 2, wherein said OTD responds to a general message from a compatible device having a general link by performing a related general task.

4. The OTD of claim 2, wherein said OTD responds to a proximity message from a compatible device having a proximity link by sending a general message if the compatible device having a proximity link is not detected for a pre-determined period of time.

5. The OTD of claim 2, wherein said OTD transmits a general message to linked compatible devices when a user input consisting of a single push of a single button is received from said user interface.

6. An object tracking system (OTS) comprising a plurality of linked object tracking devices (OTDs), each said OTD comprising:

an RF transceiver for transmitting and receiving RF signals;

user interface means for interfacing with a user, said interfacing comprising audio and visual signaling to the user and permitting user inputs to the OTD;

alarm means for producing an alarm signal;

memory means for storage of identification codes (ID) including at least one unique ID for self-identification; and processor means for processing received RF signals and user inputs, management of said memory and control of said alarm means, wherein said linked OTDs comprise OTDs that have wirelessly received and stored the IDs of at least one other OTD and each said linked OTD is responsive only to RF signals from linked OTDs.

7. The object tracking system of claim 6, comprising at least one Extension Device (ExD), said ExD comprising:

an RF transceiver for transmitting and receiving RF signals;

a user interface permitting user inputs to the ExD;

a memory for storing identification codes (IDs) including at least one unique ID for self-identification; and processor means for processing received RF signals and user inputs and management of said memory, wherein said at least one ExD establishes a wireless link with at least one of said OTDs by wirelessly transmitting its unique ID to the OTD for storage therein and receiving the OTD unique ID for storage in said ExD memory, whereby said at least one OTD is responsive to the linked ExD and the linked ExD is responsive to the at least one OTD.

8. The object tracking system of claim 7, wherein said ExD comprises a remotely controlled switch, and said ExD is responsive to a signal from said at least one OTD to actuate said switch.

9. The object tracking system of claim 7, wherein said ExD periodically transmits an RF message containing its unique ID.

10. A method for building a network comprising a plurality of linked devices, each said device comprising RF transceiver means for transmitting and receiving RF signals, user interface means for receiving user inputs and relating information to a user, memory means for storage of identification codes (IDs) including at least one unique ID for self-identification, and processor means for processing received RF signals and user inputs and management of said memory, said method comprising the steps of:

placing two of said devices in proximity to each other;

applying a user input indicative of a link request to both said devices;

exchanging the unique IDs between said devices by RF signal for storage therein or erasure therefrom; and repeating the steps of placing, applying and exchanging, whereby devices are responsive to other devices, the unique IDs of which are stored in memory.

11. The method of claim 10, comprising the steps of:

designating particular of said devices for linkage to each of the other devices in said network; and repeating the steps of placing, applying and exchanging for the particular of said devices and each of the other devices in said network.

12. The method of claim 10, wherein the step of applying comprises a single push of a single button.

* * * * *